US005881563A

United States Patent [19]

Lee et al.

[11] Patent Number: 5,881,563

[45] Date of Patent: Mar. 16, 1999

[54] ICE MAKER HAVING A POSITION CONTROL FOR AN ICE-MAKING TRAY UPON RECOVERY FROM A POWER OUTAGE

[75] Inventors: Kun Bin Lee, Seoul; Jae Eok Shim, Kyungki-do, both of Rep. of Korea

[73] Assignee: Samsung Electronics Co., Ltd., Suwon, Rep. of Korea

[21] Appl. No.: 757,753

[22] Filed: Nov. 26, 1996

[30] Foreign Application Priority Data

Nov. 30, 1995 [KR] Rep. of Korea ..... 95-45708

[51] Int. Cl.[6] ..... F25C 1/12

[52] U.S. Cl. ..... 62/71; 62/353

[58] Field of Search ..... 62/71, 137, 353

[56] References Cited

U.S. PATENT DOCUMENTS

| | | | |
|---|---|---|---|
| 3,071,933 | 1/1963 | Shoemaker | 62/71 |
| 3,208,233 | 9/1965 | Linstromberg | 62/137 |
| 3,714,794 | 2/1973 | Linstromberg et al. | 62/137 |
| 3,727,427 | 4/1973 | Eyman, Jr. et al. | 62/353 |
| 3,864,933 | 2/1975 | Bright | 62/137 |
| 4,402,194 | 9/1983 | Kuwako et al. | 62/353 |
| 4,835,978 | 6/1989 | Cole | 62/137 |

*Primary Examiner*—William E. Tapolcai

*Attorney, Agent, or Firm*—Burns, Doane, Swecker & Mathis, L.L.P.

[57] ABSTRACT

An automatic ice maker adapted for use in a refrigerator includes an ice-making tray rotatable between an upright ice-making position and an inverted ice-discharging position by a motor. A container is disposed beneath the tray for receiving ice when the tray is in the inverted position. First and second switches are each moved between first and second states in response to rotation of the tray. The second switch can be moved to its second state in response to the container being full of ice. Whenever the refrigerator is started-up, e.g., after a power outage, a controller determines whether both of the switches are in their first states. If so, an ice making operation is performed. If not, the motor is actuated in a manner tending to rotate the tray to its upright position. When the tray reaches its upright position, a stop is contacted, whereupon a load is generated at the motor, causing the controller to stop the motor.

6 Claims, 7 Drawing Sheets

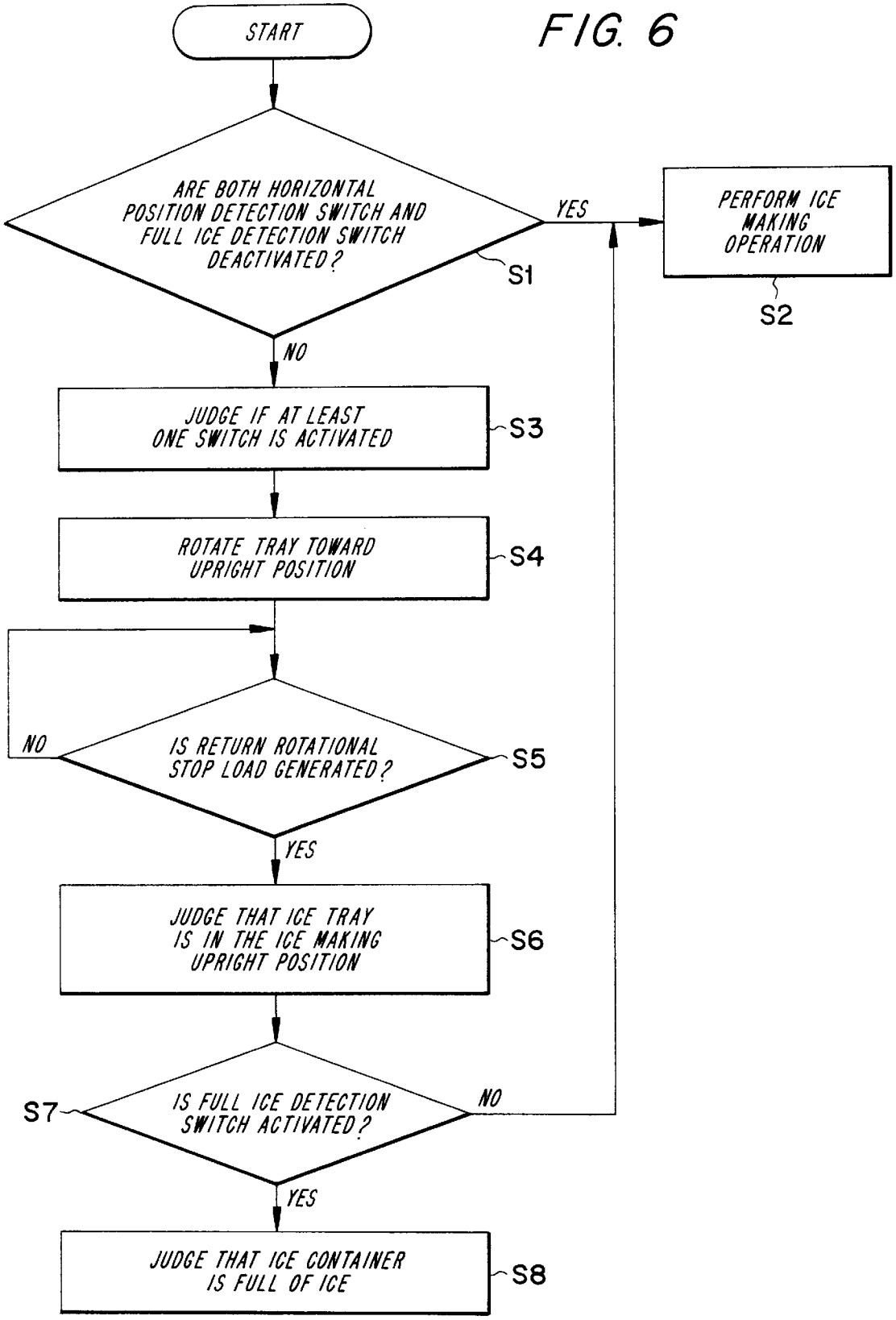
FIG. 6
START
ARE BOTH HORIZONTAL POSITION DETECTION SWITCH AND FULL ICE DETECTION SWITCH DEACTIVATED?
S1
YES
PERFORM ICE MAKING OPERATION
S2
NO
JUDGE IF AT LEAST ONE SWITCH IS ACTIVATED
S3
ROTATE TRAY TOWARD UPRIGHT POSITION
S4
NO
IS RETURN ROTATIONAL STOP LOAD GENERATED?
S5
YES
JUDGE THAT ICE TRAY IS IN THE ICE MAKING UPRIGHT POSITION
S6
S7
IS FULL ICE DETECTION SWITCH ACTIVATED?
NO
YES
JUDGE THAT ICE CONTAINER IS FULL OF ICE
S8

ICE MAKER HAVING A POSITION CONTROL FOR AN ICE-MAKING TRAY UPON RECOVERY FROM A POWER OUTAGE

RELATED INVENTIONS

This invention is related to inventions disclosed in U.S. Ser. No. 08/755,540, of Gun II Lee and Jae Eok Shim filed Nov. 21, 1996, and U.S. Ser. No. 08/757,548 of Gun II Lee filed Nov. 27, 1996.

BACKGROUND OF THE INVENTION

The present invention relates to an automatic ice maker and a position control method for an ice tray in the automatic ice maker, and more particularly, to an automatic ice maker and a position control method for an ice tray in the automatic ice maker, which can automatically control a position of the ice tray at the time of recovery from power failure.

A general automatic ice maker mounted in a freezing room of a refrigerator includes an ice tray for containing water to be made into ice, a water supply unit for supplying the water to the ice tray, an ice removal motor for inverting and re-righting the ice tray, and an ice container installed beneath the ice tray, for containing the ice. In such an automatic ice maker, water is supplied to the ice tray at the state where the ice tray is in the horizontal upright position, to then perform ice making. If the ice making is completed, the ice tray is inverted by the ice removal motor, to thereby displace the ice from the ice tray to the ice container. If the ice is separated from the ice tray, the ice tray is returned to the former horizontal position for ice making, whereupon water supply and ice making operations are resumed. A level detection switch is provided to detect as to whether the ice tray remains at an ice making horizontal position. Meanwhile, a full ice detection switch is operated by a full ice detection lever to recognize whether the ice container is full of ice. If a full ice state has been recognized, ice making is stopped.

In such a conventional automatic ice maker, when a refrigerator is initially installed, or is re-activated after it has been deactivated owing to the failure of power supply, it cannot be accurately judged as to whether or not the ice tray is in a horizontal position for making ice. For example, when the power failure occurs, the ice tray may be in an inverted position for removing the ice, but the level detection switch comes to recognize that the ice tray is in an upright position. If an ice making operation is then performed, water supplied to the ice tray is not contained in the ice tray but falls into the ice container to thereby spoil already-made ice.

To accurately position an ice tray at the time of power recover, a mechanism shown in FIG. 7 is employed in the technology disclosed in Japanese patent laid-open publication No. Hei4-124570. In this known art, a first marker 120 for indicating an ice making upright position and a second marker 121 for indicating an inverted position are provided on a rotational body 119 which rotates along with an ice tray 109. These two markers 120 and 121 are formed of a different length from each other. Also, a light emitting diode (LED) 123 and a photo transistor 124 opposing the LED 123 are provided as a detection means for detecting the position of the marker 120 or 121. Based on the output signal of the photo transistor 124, a position of the ice tray 109 is judged, to place the ice tray 109 in the ice making upright position. If power is supplied at the time of power recovery, the ice tray 109 is rotated in a predetermined direction, for example, in the direction opposite to an arrow shown in FIG. 7, and at the same time a time counting operation starts. The markers 120 and 121 detected during the rotational operation are distinguished via the counted duration time, to thereby determine a position of the corresponding ice tray 109 at the time of power failure. The ice tray 109 is then returned to the former (power-recovery) position or is remains in its current state according to the determination result, to thereby cause the ice tray 109 to be in an ice making upright position.

However, in the above prior art, since it is necessary to rotate the ice tray in order to determine its position when power is resumed, a comparatively complicate determination process is needed and much time is consumed for determining the position of the ice tray and positioning the ice tray. Also, additional elements such as a LED and a photo transistor are needed.

SUMMARY OF THE INVENTION

To solve the above problem, it is an object of the present invention to provide an automatic ice maker and a position control method for the automatic ice maker therein, which can effectively control a horizontal position of an ice tray using an existing level detection switch and an existing full ice detection switch and without using an additional mechanism.

To accomplish the above object of the present invention, there is provided an automatic ice maker having an ice tray, an ice removal motor for reversing and returning the ice tray via a gear train, and an ice container which is installed below the ice tray, the automatic ice maker comprising:

a horizontal position detection switch for detecting as to whether said ice tray is in the horizontal position;

a first detection cam which rotates along with a rotating axis of the ice tray, and enables the horizontal position detection switch to operate in correspondence to at least both an ice making horizontal position and a reversed position of the ice tray;

a full ice detection lever for ascending or descending according to an amount of ice in the ice container;

a full ice detection switch which operates by the full ice detection lever at the time when the ice container is full of the ice;

a second detection cam which rotates along with the rotating axis of the ice tray, and enables the full ice detection switch to operate in correspondence to at least the reversed position of the ice tray; and a controller for controlling the ice removal motor so that the ice tray is returned to the ice making horizontal position when at least one of the horizontal position detection switch and the full ice detection switch is in an enabled state at the time of power input.

Here, it is preferable to further provide a stop protrusion which rotates along with the rotating axis of the ice tray, and a return rotation stopper which is engaged with the stop protrusion at the time when the ice tray is returned to the former position, to thereby stop the ice tray in an ice making horizontal position. Also, the present invention further comprises a return rotational load detection circuit for detecting a return rotational load at the time when the ice tray is returned. In this case, the controller can judge that the ice tray reaches the ice making horizontal position when the return rotational load exceeds a predetermined stop load.

There is also provided a position control method for an automatic ice maker having an ice tray, an ice removal motor for reversing and returning the ice tray via a gear train, and an ice container which is installed below the ice tray, the position control method for an automatic ice maker comprising the steps of:

providing a horizontal position detection switch which operates in correspondence to an ice making horizontal position and a reversed position of the ice tray;

providing a full ice detection switch which operates when the ice container is full of the ice by a full ice detection lever which ascends and descends according to an amount of the ice in the ice container and when the ice tray is in the reversed position; and controlling the ice removal motor so that the ice tray is returned to the ice making horizontal position when at least one of the horizontal position detection switch and the full ice detection switch is in an enabled state at the time of power input.

Here, it is preferable that if the full ice detection switch is in the enabled state when the return operation of the tray is completed, since it is judged that the ice container is full of the ice, an ice making operation does not resume accordingly.

BRIEF DESCRIPTION OF THE DRAWINGS

FIGS. 3 and 4 are side views showing operational states of the automatic ice maker, wherein FIG. 3 is an intermediate state of the tray between upright and inverted states (and the ice container may or may not be full), and FIG. 4 shows the tray in an inverted ice-discharging state (and the ice container may or may not be full).

FIG. 6 is a flow-chart diagram showing a control process for controlling a horizontal position according to the present invention.

DETAILED DESCRIPTION OF THE PREFERRED EMBODIMENT

A preferred embodiment of the present invention will be described below in more detail with reference to the accompanying drawings.

Figure 1:
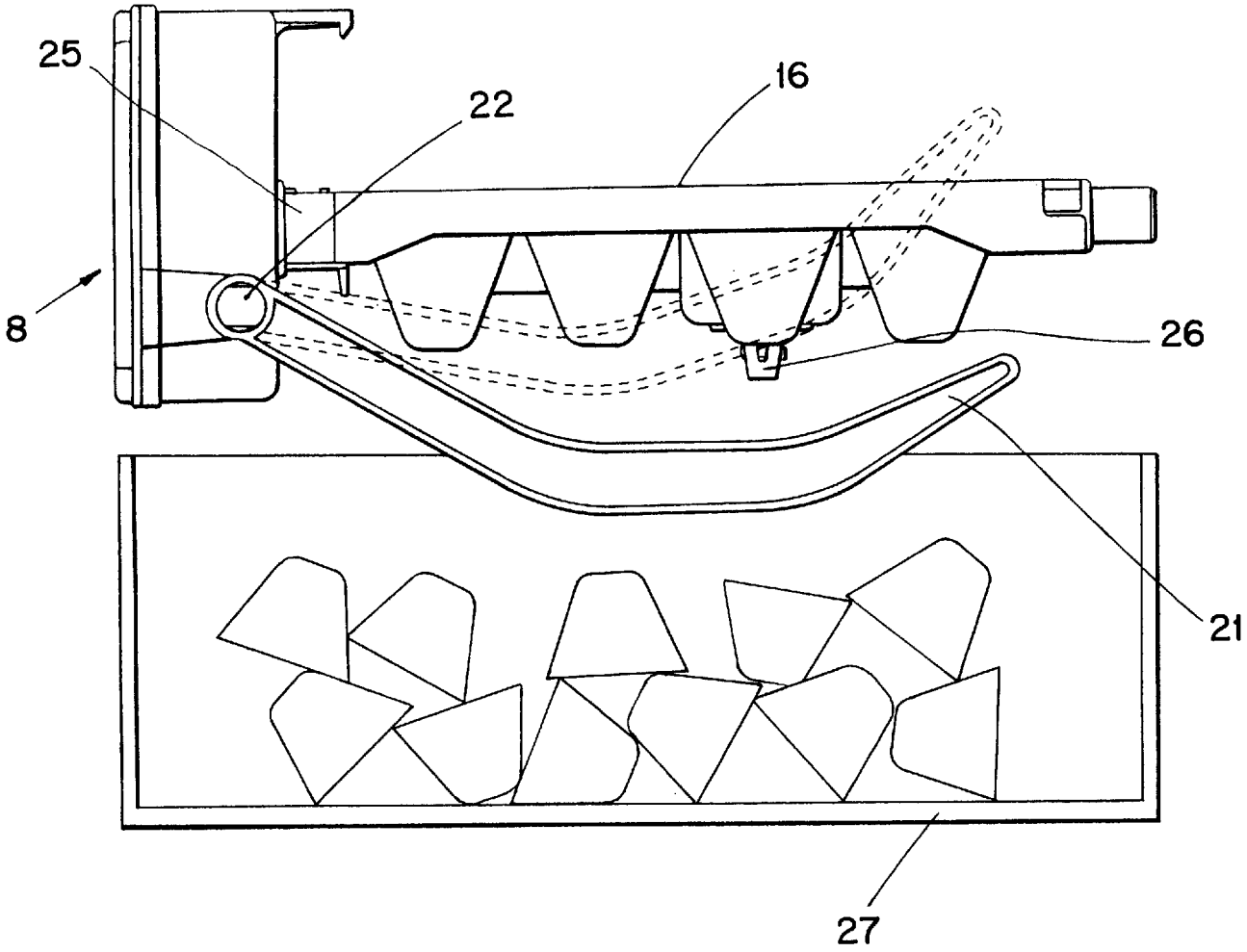
FIG. 1 is a front view showing essential elements of an automatic ice maker according to the present invention.

In FIG. 1 showing essential elements of an automatic ice maker according to the present invention, an ice tray 16 containing water to be made into ice is rotatably supported in a housing 8 via a tray rotation axle 25. An ice removal temperature sensor 26 for generating a temperature signal to enable an ice removal time to be judge in accordance with a temperature of the ice tray 16 is attached to the bottom of the ice tray 16. An ice container 27 containing ice separated from the ice tray 16 is provided below the ice tray. A full ice detection lever 121 is rotatably installed in the housing 8 so that it rotates on an axle 22. The full ice detection lever 21 ascends and descends according to an amount of ice in the ice container 27. When the ice container 27 is in the full ice state, the full ice detection lever 21 ascends as shown as a dotted line in FIG. 1, to activate a full ice detection switch to be described later to inform a microprocessor (not shown) of the full ice state.

Figure 2:
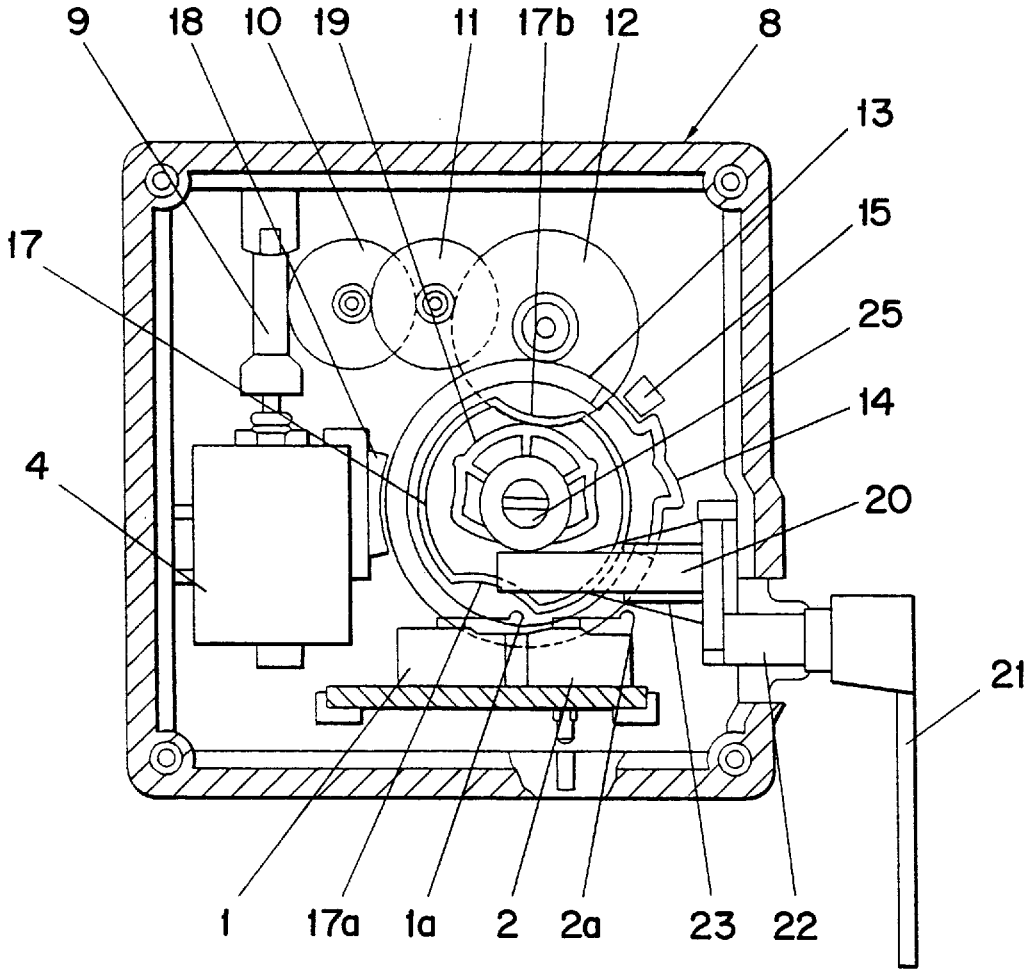
FIG. 2 is a side view showing an automatic ice maker according to the present invention when the ice tray is upright and the ice container is not full.

FIG. 2 is a side view showing the automatic ice maker according to the present invention. An upright position detection switch 1 for detecting a horizontal upright position of the ice tray 16 and a full ice detection switch 2 for detecting whether the ice container 27 is full of ice, are disposed in parallel in the housing 8. These switches 1 and 2 are composed of a micro-switch, respectively. The horizontal position detection switch 1 and the full ice detection switch 2 include respective switch levers 1*a* and 2*a* which operate by pressure applied from the upper direction in the drawing. An ice removal motor 4 for rotating the ice tray 16 forward and backward is installed in one side of the housing 8. The ice removal motor 4 provides a decelerated rotational force via a deceleration gear train including a worm gear and first through third gears 10, 11 and 12, to an end gear 13. The tray rotational axle 25 is fixed in the center of the end gear 13, to accordingly enable the ice tray 16 to rotate forward (counter-clockwise in FIG. 2) and reverse (clockwise in FIG. 2).

A stop protrusion 14 is provided on the outer circumference of the end gear 13. The stop protrusion 14 contacts a return stopper 15 provided in correspondence to an ice making horizontal upright position of the ice tray 16, to prevent the end gear 13 from rotating counterclockwise therepast (see FIG. 2) and also contacts a reverse stopper 18 attached to the ice removal motor 4 to prevent the end gear 13 from rotating in a reverse (clockwise) rotational direction from the position shown in FIG. 4.

A first detection cam 17 for indicating a horizontal upright position of the ice tray 16 together with the upright position detection switch 1, is fixed-on the end gear 13. The first detection cam 17 has a generally circular cam profile in which an ice making position detection groove 17*a* and an inverted position detection groove 17*b* are formed in diametrically opposed positions in correspondence to the upright ice making position and the inverted position. The switch lever 1*a* of the upright position detection switch 1 contacts the circular profile of the first detection cam 17. The switch lever 1*a* is pressurized when the switch lever 1*a* contacts circular cam profile of the first detection cam 17, to activate the upright position detection switch 1, while the switch lever 1*a* is released from the pressure when the switch lever 1*a* contacts either the ice making position detection groove 17*a* or the inverted position detection groove 17*b,* to deactivate the upright position detection switch 1.

A second detection cam 19 is fixed to the end gear 13. The second detection cam 19 has a small radius of curvature opposing the ice making position detection groove 17*a,* and has a larger radius of curvature opposing the inverted position detection groove 17*b.* A function arm 20 contacts the cam profile of the second detection cam 19. The function arm 20 ascends and descends according to rotation of the second detection cam 19. The function arm 20 is eccentrically installed on the axle 22 of the full ice detection lever 21. Accordingly, the full ice detection lever 21 ascends and descends according to the descending and ascending of the function arm 20, and vise versa. If the function arm 20 descends, a function rib 23 provided in the surface of the function arm 20 acts on the switch lever 2*a* of the full ice detection switch 2 to activate the full ice detection switch 2. Thus, the full ice detection switch 2 is activated by descending of the function arm 20 due to the rotation of the second detection cam 19 as well as by an ascending condition of the full ice detection lever 21 due to the full of the ice container 27 of FIG. 1.

Figure 3:
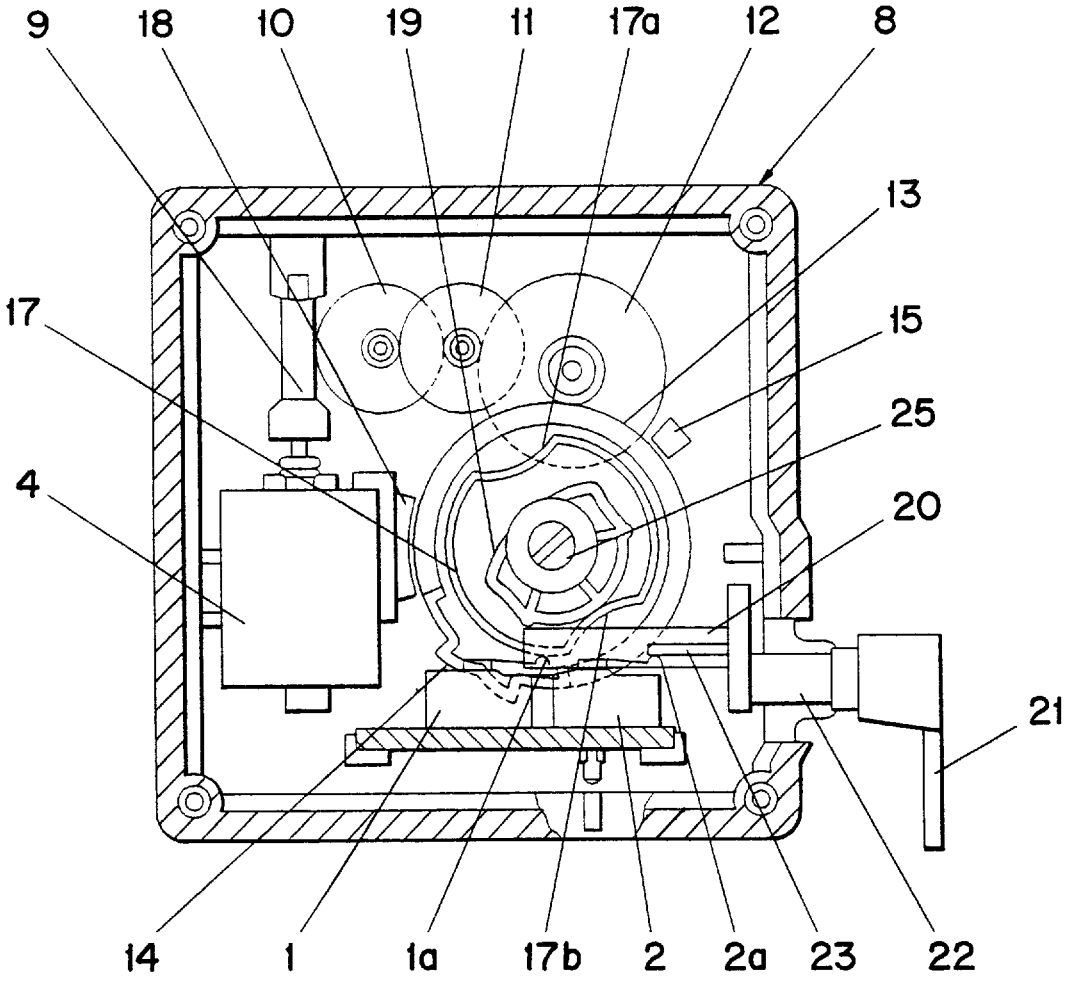
Figure 4:
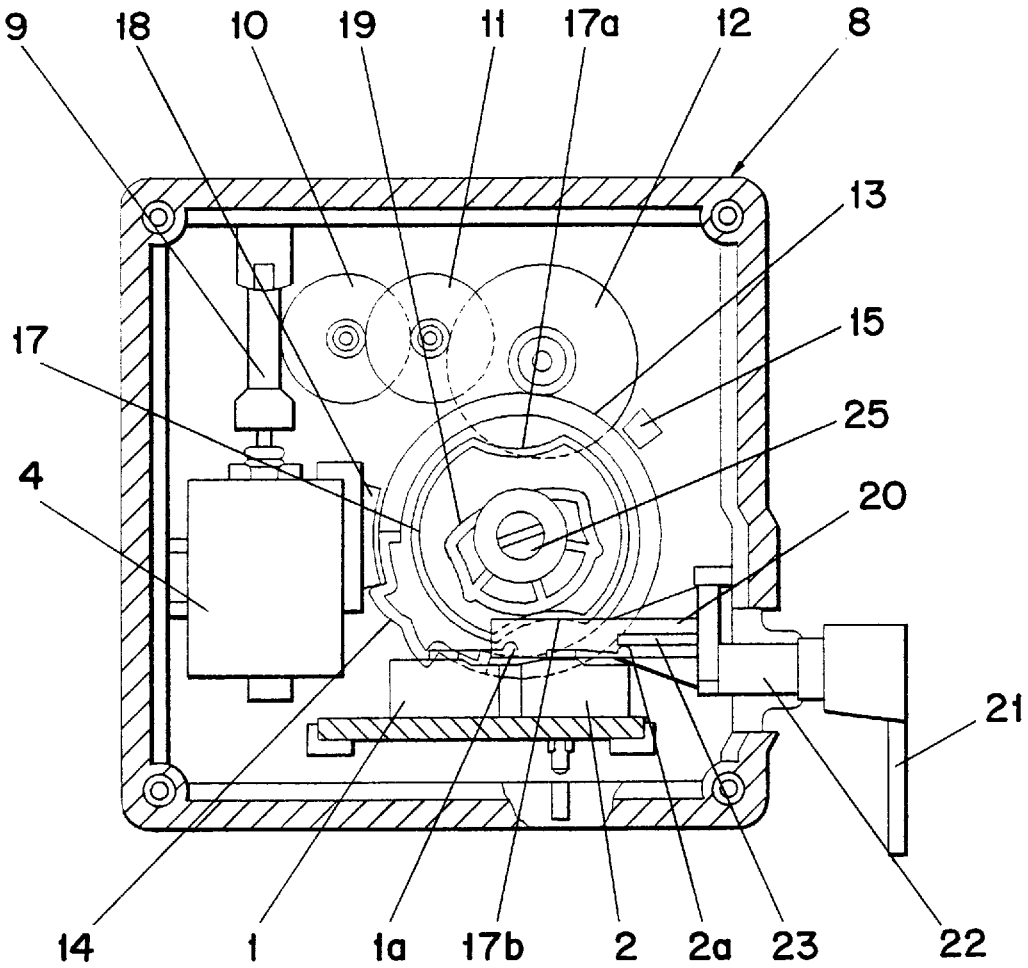

FIG. 2 shows a state where the ice tray 16 is in the upright ice making position and FIGS. 3 and 4 are side views showing other operational states of the automatic ice maker.

In FIG. 4 the tray is in an inverted ice-removal state, and in FIG. 3 the tray is in an intermediate state between the upright and inverted states. In FIG. 2 the ice container is not full; in FIGS. 3 and 4 the ice container may or may not be full. At the state where the stop protrusion 14 of the end gear 13 contacts the return rotational stopper 15 to maintain the ice tray 16 in the upright position as shown in FIG. 2, the upright position detection switch 1 is deactivated since the switch lever 1*a* is positioned in the ice making position detection groove 17*a* of the first detection cam 17. Also, the full ice detection switch 2 is deactivated since the function arm 20 is contacted by the small radius portion of the second detection cam 19 and does not descend.

In this state, a microcomputer (not shown) determines an ice removal time according to a temperature signal of the ice removal temperature sensor 26. If the ice removal motor 4 is driven in a reverse (clockwise) direction, the ice tray 16 is rotated in the reverse direction. Then, as can be seen from FIG. 3, the horizontal position detection switch 1 is activated since the switch lever 1*a* moves out of the ice making position detection groove 17*a* of the first detection cam 17 and is pressurized. At the same time, the function arm 20 descends due to contact with the larger radius portion of the second detection cam 19. Accordingly, the function rib 23 of the function arm 20 presses the switch lever 2*a* of the full ice detection switch 2 to activate the full ice detection switch 2.

If the ice removal motor 4 is further rotated, the stop protrusion 14 of the end gear 13 contacts the reverse rotation stopper 18, to accordingly stop the rotation of the end gear 13. In this case, the ice tray 16 is in the inverted position, and the switch lever 1*a* of the horizontal position detection switch 1 is positioned in the inverted position detection groove 17*b* of the first detection cam 17 to deactivate the horizontal position detection switch 1, and the full ice detection switch 2 is still in an activated state. Here, the ice tray 16 is inverted to displace the ice from the ice tray 16 and into the ice container 27. Then, the ice removal motor 4 returns the ice tray 16 to the upright ice making horizontal position of FIG. 2.

As described above, combination of operational states of the horizontal position detection switch 1 and the full ice detection switch 2 is varied according to the rotational position of the ice tray 16. That is, when the ice tray 16 is in the ice making upright position, both switches 1 and 2 are deactivated. The switches 1 and 2 are always maintained in an activated state when the tray is in an interval between the ice making position and the inverted position. If the ice tray 16 is in the inverted position, the horizontal position detection switch 1 is deactivated and the full ice detection switch 2 is activated. When the ice container 27 is full of ice, the full ice detection switch 2 is always maintained in the activated state.

Figure 5:
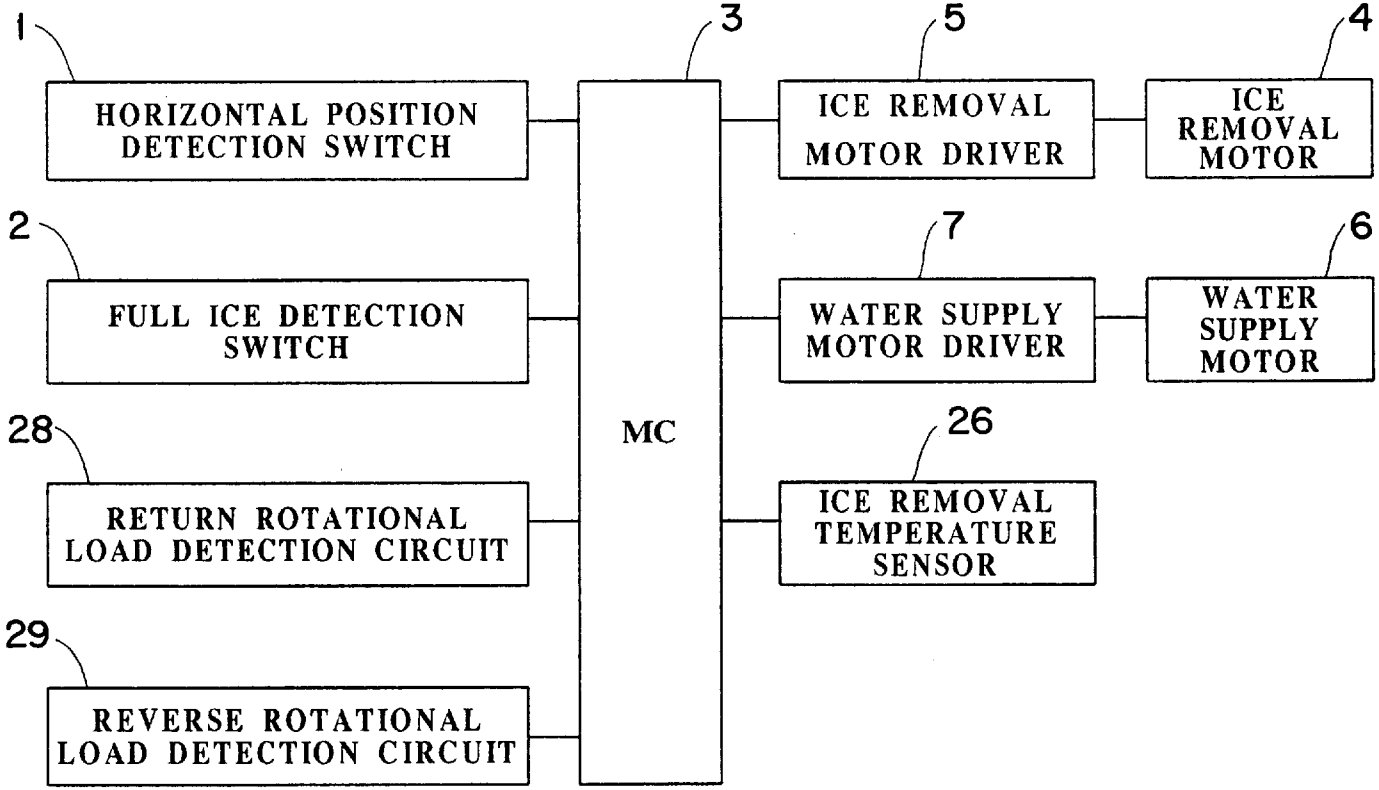
FIG. 5 is a schematic block diagram showing the control operation of the present invention.
Figure 7:
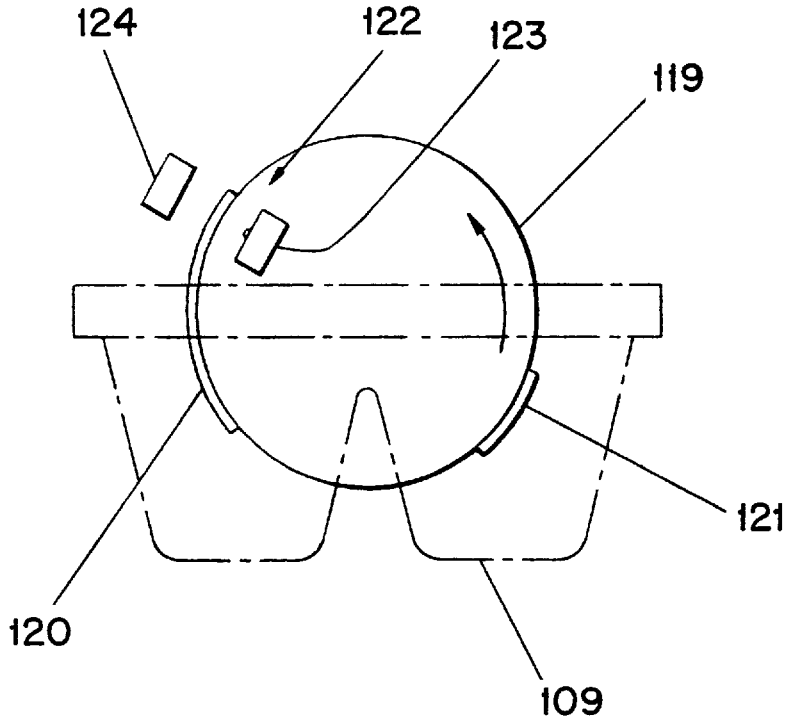
FIG. 7 is a schematic side view of a conventional automatic ice maker.

FIG. 5 is a schematic block diagram showing the control operation of the automatic ice maker according to the present invention. A microcomputer 3 functioning as a controller receives signals from the horizontal position detection switch 1, the full ice detection switch 2 and an ice removal temperature sensor 26, and controls the ice removal motor 4 via the ice removal motor driver 5. The microcomputer 3 controls a water supply motor 6 via a water supply motor driver 7. Also, the microcomputer 3 receives signals from a return rotational load detection circuit 28 and a return rotational load detection circuit 29.

The return rotational load detection circuit 28 detects an excessive load, that is, a return rotational stop load generated when the end gear 13 does not rotate past the ice making horizontal position since the stop protrusion 14 contacts the return stopper 15, and provides the detected return rotational stop load to the microcomputer 3. The microcomputer 3 judges that the ice tray 16 is in an ice making upright position based on the detected return rotational stop load and interrupts the operation of the ice removal motor 4. Likewise, the return rotational load detection circuit 29 detects an excessive load, that is, a reverse rotational stop load generated when the end gear 13 does not rotate since the stop protrusion 14 contacts the reverse rotational stopper 18, and provides the detected reverse stop load to the microcomputer 3. The microcomputer 3 interrupts the reverse operation of the ice removal motor 4, based on the detected reverse rotational stop load.

FIG. 6 is a flow-chart diagram showing a control process for controlling a position of the ice tray 16 by the microcomputer 3 according to the present invention. When power is input at the time of power recovery, the microcomputer 3 checks whether both the horizontal position detection switch 1 and the full ice detection switch 2 are in the deactivated states (step S1). If the two switches 1 and 2 are in the deactivated states, it is judged that the ice tray 16 is in the ice making position and the ice container 27 is not full of ice, whereupon the microcomputer 3 activates the water supply motor 6 via the water supply motor driver 7 and then supplies water to the ice tray 16 to start an ice making operation.

If at least one of the horizontal position detection switch 1 and the full ice detection switch 2 is activated (i.e., "No." at step S1), the microcomputer 3 judges that the ice tray 16 is not in the upright position (step S3), and drives the ice removal motor 4 to return the ice tray 16 to the upright position (Step S4). When a signal representing a return rotational stop load from the return rotational load detection circuit 28 during return of the ice tray 16, is input to the microcomputer 3 (step S5), that means that the stop protrusion 14 of the end gear 13 has contacted the return rotational stopper 15. Here, the microcomputer 3 judges that the ice tray 16 has reached the ice making upright position (step S6).

If the full ice detection switch 2 is in the deactivated state (step S7) although the ice tray 16 has reached the ice making horizontal position, that means that a further ice making operation should not be performed since the ice container 27 is full of ice (step S8). Thus, the microcomputer 3 stands by until ice contained in the ie container 27 is removed. If the full ice detection switch 2 is not in the activated state (step S7) when the ice tray 16 is in the ice making position, the microcomputer 3 performs the ice making operation (step S3).

As described above, the present invention uses an existing horizontal position detection switch and an existing full ice detection switch without the need for additional elements, to thereby accurately and quickly control a position of the ice tray at the time of the power recovery.

What is claimed is:

1. An automatic ice maker adapted for use in a refrigerator, comprising:

an ice tray rotatable about an axis;

a motor operably connected to the tray for rotating the tray between an ice-making upright position and an ice-removing inverted position;

a container disposed beneath the tray for receiving ice from the inverted tray;

a first switch movable between first and second states;

a first cam connected for rotation with the tray for positioning the first switch in its first position in response to the tray being in it upright position;

a second switch movable between first and second states;

a detector for detecting a condition wherein the container is full of ice and for moving the second switch to its second state in response to the container being full of ice;

a second cam connected for rotation with the tray for moving the second switch to its first state when the ice tray is in the upright position at a time when the detector detects a non-full condition of the container; and a controller connected to the first and second switches and to the motor and being responsive to the refrigerator being started-up, or operating the motor in a manner tending to rotate the tray in a direction toward its upright position in response to the first switch being in its second state regardless of the position of the second switch, and in response to the second switch being in its second state regardless of the position of the first switch.

2. The automatic ice maker according to claim 1 further including a stop for preventing the tray from rotating in the direction past the upright position and simultaneously causing a stop load to be generated at the motor, the controller stopping the motor in response to the generation of the stop load.

3. The automatic ice maker according to claim 2 wherein the stop constitutes a first stop and the direction constitutes a first direction, the ice maker further comprising a second stop for preventing the tray from rotating in a second, opposite direction past the inverted position and simultaneously causing a second stop load to be generated at the motor, the controller being operable to stop the motor in response to the generation of the second stop load.

4. The automatic ice maker according to claim 1 wherein the first cam moves the first switch to its first position whenever the tray is in the upright and inverted positions.

5. A method of controlling a position of an automatic ice making tray of a refrigerator during a start-up of the refrigerator; the tray being connected to an electric motor which rotates the tray between an upright ice-making position and an inverted ice-removing position for discharging ice into a container; a detector provided for detecting a condition when the container is full of ice; there being provided first and second electric switches each movable between first and second states in response to rotation of the tray; the second switch being movable to its second state in response to the container being full of ice; the first switch being in its first state whenever the tray is in the upright position; the second switch being in its first state when the tray is in the upright position in a non-full condition of the container, the method comprising the steps of:

A) determining, upon a start-up of the refrigerator, whether both of the first and second switches are in their respective first states;

B) performing an ice making operation upon determining in step A that both of the first and second switches are in their respective first states;

C) operating the tray-rotating motor in a manner tending to rotate the tray in a direction toward its upright position upon determining in step A that the first switch is in its second state, regardless of the position of the second switch;

D) operating the tray-rotating motor in a manner tending to rotate the tray in a direction toward its upright position upon determining in step A that the second switch is in its second state, regardless of the position of the first switch; and E) performing an ice making operation in response to the second switch being in its first state following the rotation of the tray to its upright position.

6. The method according to claim 5 further including a step of preventing the tray from rotating past the upright position and simultaneously causing a stop load to be generated at the motor, step C comprising operating the motor until the stop load is sensed.

* * * * *